United States Patent [19]

Huppert et al.

[11] 4,364,102

[45] Dec. 14, 1982

[54] INTERNALLY LIGHTED DECORATIVE DISPLAY

[76] Inventors: Vaughn P. Huppert, 9445 Goodwick Ct., San Diego, Calif. 92123; Richard J. Castoro, 1940 Park Dale La., Encinitas, Calif. 92024

[21] Appl. No.: 174,588

[22] Filed: Aug. 1, 1980

[51] Int. Cl.[3] ..... F21P 1/02

[52] U.S. Cl. ..... 362/123; 362/122; 362/184; 362/190; 362/191; 362/202; 362/208; 362/216; 362/217; 362/218; 362/225; 362/249; 362/252; 362/294; 362/310; 362/806

[58] Field of Search ..... 362/184, 123, 190, 806, 362/191, 122, 202, 208, 216, 217, 218, 225, 249, 252, 294, 310, 806

[56] References Cited

U.S. PATENT DOCUMENTS

| | | | |
|---|---|---|---|
| 3,532,874 | 10/1970 | Rosenast | 362/123 |
| 3,564,231 | 2/1971 | Bruce et al. . | |
| 3,641,335 | 2/1972 | Wall | 362/123 |

*Primary Examiner*—Stephen J. Lechert, Jr.
*Attorney, Agent, or Firm*—Harvey B. Jacobson

[57] ABSTRACT

An internally illuminated optical display comprises a hollow interior containing therein a light source and in which the internal surface of said display is coated with a highly light reflective coating, the display including light holes and/or transparent or translucent bulbs which emit the light reflected in the interior of the display to the exterior thereof. The display can be in the form of a Christmas tree in which the trunk of the tree is hollow and contains a light source connected to an electrical outlet or electrical storage battery, the branches of the tree being inserted into the trunk and including a hollow portion, the hollow interior of the trunk and branches being coated with the light reflective coating and including light emitting holes and/or bulbs thereon. The internally lighted optical display can also be in the form of a wreath which utilizes the principles of decorative lighting disclosed in the invention.

12 Claims, 10 Drawing Figures

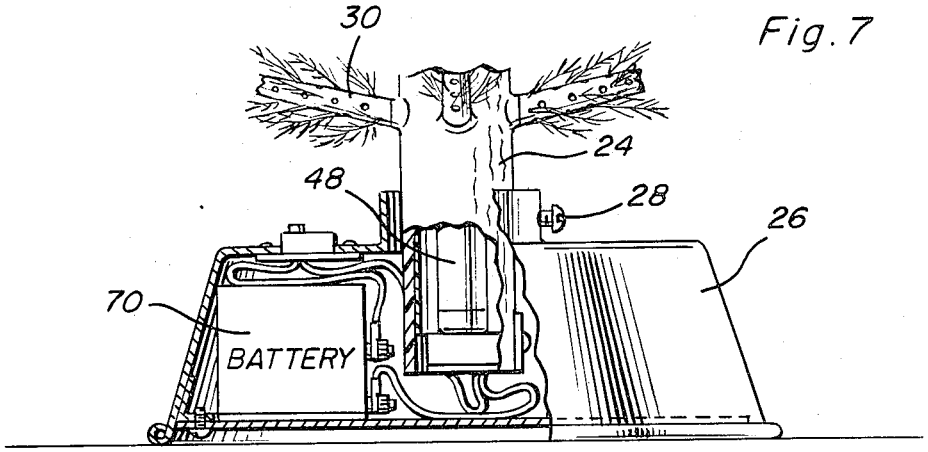
Fig. 7
Fig. 8
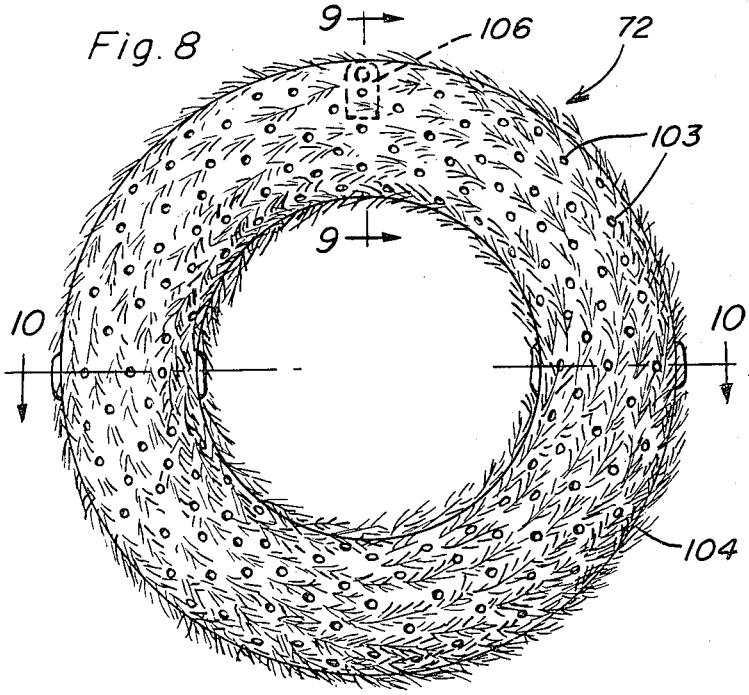
Fig. 9
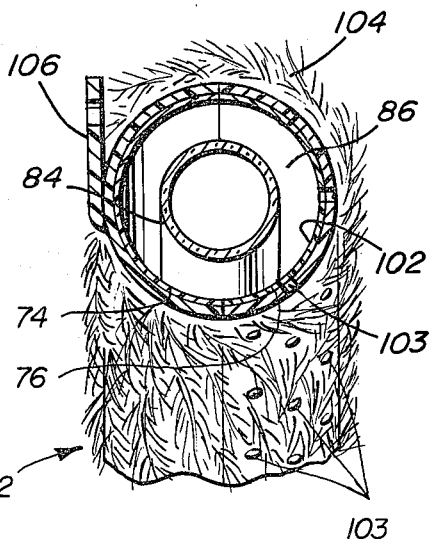
Fig. 10
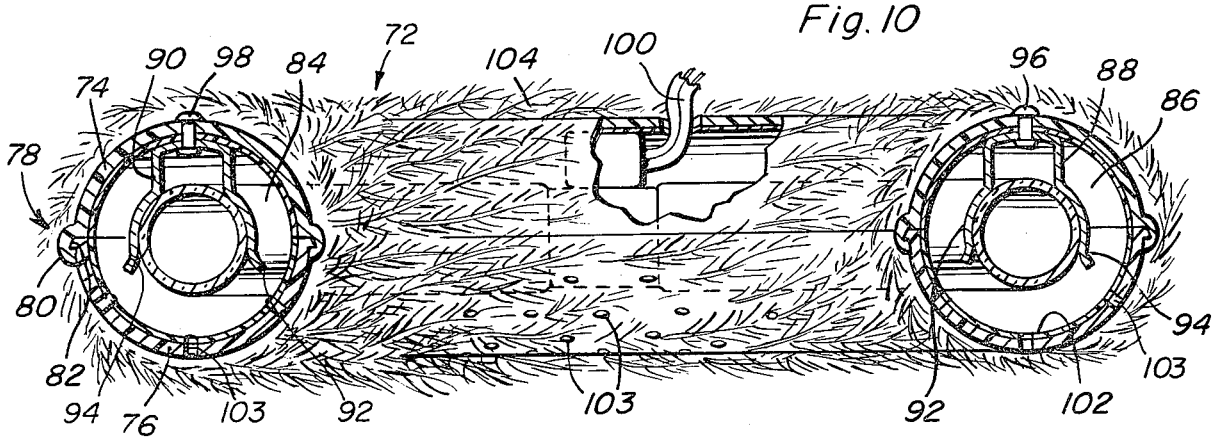

INTERNALLY LIGHTED DECORATIVE DISPLAY

BACKGROUND OF THE INVENTION

1. Field of the Invention

This invention relates to internally lighted decorative displays, and in particular to a lighted display which eliminates the hazards associated with conventional electrically lighted optical displays. More particularly, the invention relates to a decorative display in the form of a Christmas tree or wreath which is internally lighted and which transmits the light to the exterior of the display and emits the light to produce a decorative effect, eliminating the need for externally wired light-emitting bulbs.

2. Disclosure Statement

One very popular type of illuminated ornamental display is a Christmas tree, and efforts have been made to provide an artificially illuminated Christmas tree by employing light transmitting pipes and other types of light conductors including optical fibers. Christmas tree displays utilizing optic fibers for illumination include U.S. Pat. Nos. 3,766,376, issued Oct. 16, 1973; 4,060,722, issued Nov. 29, 1977; and 4,068,118, issued Jan. 10, 1978. In U.S. Pat. No. 3,766,376, a background discussion of several other patent citations are mentioned which disclose light conducting pipes for illuminating an artificial Christmas tree. These patent citations include U.S. Pat. No. 1,921,614 to Fry Jr., U.S. Pat. No. 2,227,861 to Petrone and U.S. Pat. No. 3,465,139 to Siegal. These patented devices show elongated glass or plastic rods which extend through the trunk of the Christmas tree to conduct light to or through the branches thereof. U.S. Pat. No. 3,735,117, issued May 22, 1973, discloses an artificial Christmas tree having a built in electrical circuit, the tree including a tree trunk and a series of sidewardly radiating tree branches, the trunk and branches having electrical wiring therein leading from a transformer in the tree stand to electrical lamp sockets scattered upon the twigs and branches. Other decorative displays utilizing optic fibers for illumination include U.S. Pat. No. 3,766,374, issued Oct. 16, 1973, and U.S. Pat. No. 3,536,908, issued Oct. 27, 1970.The illuminated optical display of the present invention eliminates the need for structures required to bundle a mass of fragile optical fibers and eliminates the safety hazard ever present with the use of large amounts of electrical wiring to provide illumination. The light-reflective coatings placed on the interior surface of the display in accordance with the present invention eliminates the need for individual electrically connected bulbs and for the mass of optical fibers, yet produces the multi-colored effect of these prior art methods of illuminating optical displays.

SUMMARY OF THE INVENTION

In accordance with the present invention an internally illuminated optical display utilizes a single and elongated source of light placed into the hollow interior of the display. The internal surfaces of the display are covered with a light-reflective layer or coating which reflects and transmits the light from the light source to the exterior of the display wherein the reflected light is emitted therefrom. The light is emitted from the exterior of the display by means of transparent or translucent bulbs communicating with the hollow interior or by means of light holes extending from the exterior of the display into the hollow interior. The light-reflective layer is preferably in the form of a coating which may include variations in color to produce desired shades of light emitted from the exterior of the display.

Preferably, the optical display is in the form of a Christmas tree and wreath. The Christmas tree display of the present invention utilizes a hollow trunk containing a light source into which hollow elongated branches are installed. The internal surfaces of the trunk and branches are coated with a light-reflective layer which reflects and transmits the light from the light source to the exterior of the trunk and branches. The light-reflective coating can be varied along the trunk and branches to provide a multi-colored effect. The display wreath utilizes the same principle of illumination in which an internal light source is inserted in the hollow body of the wreath. The internal surfaces are coated with a light-reflective layer which reflects and transmits the light from the annular shaped light source to the exterior surfaces of the wreath. As in the Christmas tree display, the light-reflective coating on the internal surfaces of the wreath can be varied to produce varied color effects. The Christmas tree and wreath displays of the present invention greatly reduce the electrical fire hazards associated with externally wired displays. Further, there are no electrically connected exterior bulbs which will burn out or which become hot and pose a hazard to children. Preferably, the Christmas tree display is comprised of at least two trunk halves and a series of branches which can be installed quickly and which can be stored in a minimum amount of space. In all forms of the optical display of the present invention, the body of the display can be formed of a molded metal or plastic material in which the inside surface is coated, such as by spraying, dipping, etc., with the light-reflective layer, such as chrome or other highly reflective resin coatings to produce the multi-colored illumination from the exterior of the display. The elimination of external wiring and a plurality of light sources, such as electrically wired bulbs or a plurality of thin optic fibers greatly reduces the cost of the optical display to produce which in turn greatly reduces consumer cost.

Accordingly, it is an object of the present invention to provide an optical display which emits a wide variety of colors, yet does not require a plurality of electrically connected external sources of light.

Another object of the invention is to provide an internally lighted optical display which does not require a plurality of optic fibers to emit light from the exterior of the display.

Another object of the invention is to greatly reduce the electrical fire hazard associated with optical displays having a multi-colored exterior produced by electrically connected sources of light.

Still another object of the present invention is to provide an internally lighted optical display in which a single light source is utilized and in which the light emitted from the light source can be transmitted and reflected to the exterior of the display in a wide variety of colors.

Still yet another object of the invention is to provide an internally lighted optical display in the form of a Christmas tree or wreath which is easy to install, greatly reduces the electrical fire hazard commonly associated with such devices and can be produced at minimum expense.

These together with other objects and advantages which will become subsequently apparent reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

FIG. 7 is a fragmented elevational view of a Christmas tree display illustrating the base of the display in section and the alternative use of an electrical storage battery as the power source for the internal source of light.

FIG. 8 is an elevational view of an alternative form of the optical display of the present invention in which the display is in the form of a wreath.

FIG. 9 is a transverse sectional view of the wreath display taken generally along the line 9—9 of FIG. 8.

FIG. 10 is a sectional view of the wreath display taken generally along the line 10—10 of FIG. 8.

DETAILED DESCRIPTION OF THE INVENTION

Figure 1:
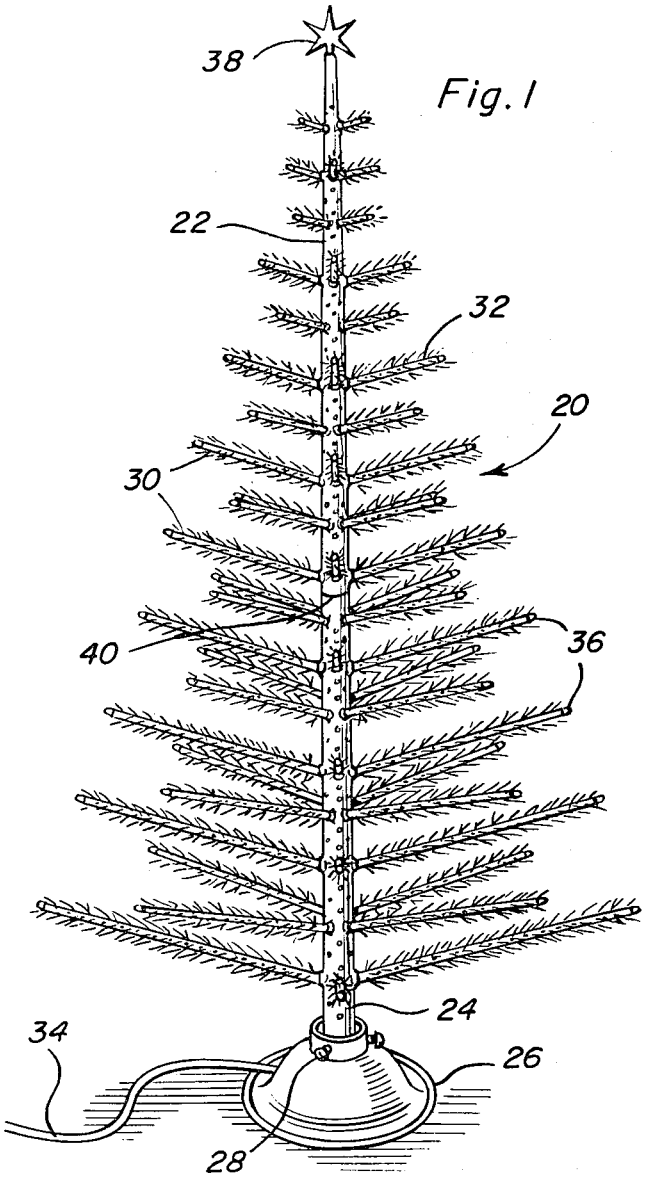
FIG. 1 is a perspective view of the optical display of the present invention in the form of a Christmas tree.

In FIG. 1, there is shown an internally lighted optical display of the present invention in the form of a Christmas tree 20. Tree 20 includes an upper trunk half 22 and lower trunk half 24 secured to hollow base or stand 26. Trunk half 24 is secured within stand 26 by means of screws 28 which are urged against trunk half 24 and firmly support tree display 20. Inserted within each trunk 22 and 24 are a plurality of branches 30 each containing a plurality of simulated evergreen needles 32. The source of light 48 which illuminates Christmas tree display 20 is connected to a conventional starter circuit (not shown) and to a source of electrical current by means of electrical cord 34 the starter circuit may be positioned in the stand 26. The light emitted from the internal light source 48 is transmitted and reflected through trunk halves 22 and 24 and branches 30 and emitted from the exterior thereof by means of a plurality of light holes 52 communicating with the interior of the tree and/or by a series of transparent or translucent bulbs, such as bulbs 36 placed at the end of each branch 30. Bulb 38 at the top of the tree communicates with the interior of trunk half 22. Trunk halves 22 and 24 and branches 30 can be formed of metal or plastic. The formation of trunk halves 22 and 24 of plastic enables the trunk to be molded into a shape resembling the shape and texture of an evergreen tree, enhancing the beauty and natural appearance of the optical display.

Figure 2:
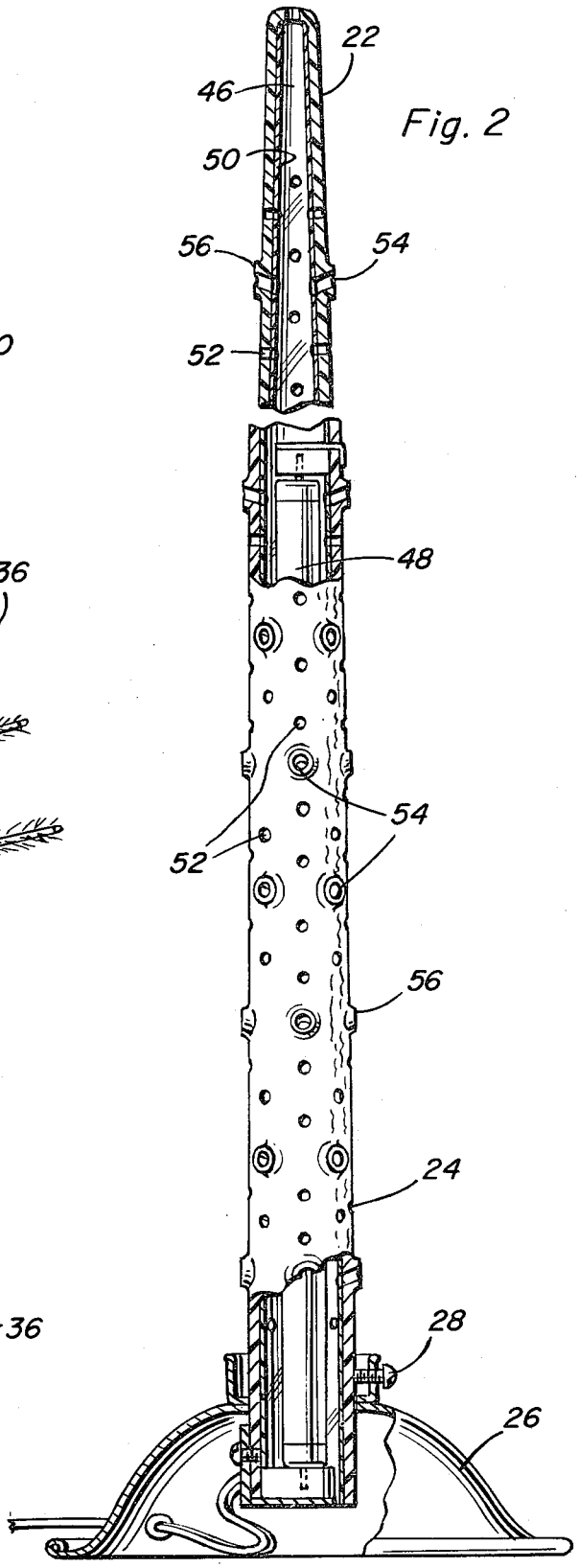
FIG. 2 is an enlarged elevational view of the trunk of the Christmas tree display, partly in section, illustrating the interior of the trunk and base.
Figure 3:
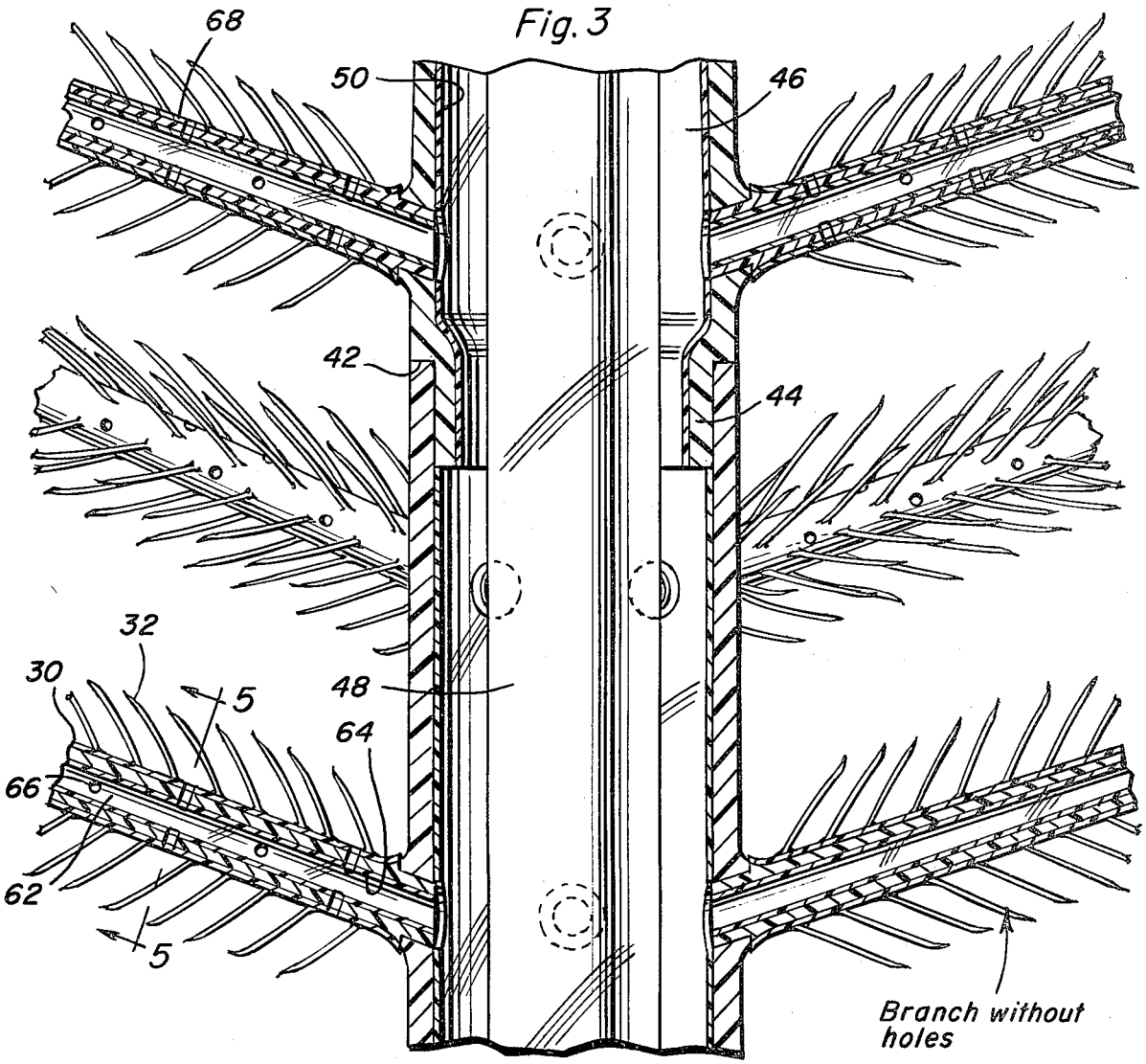
FIG. 3 is an enlarged sectional view of the Christmas tree display of FIG. 1 illustrating the hollow trunk and internal light source of the display and the attached hollow branches.
Figure 6:
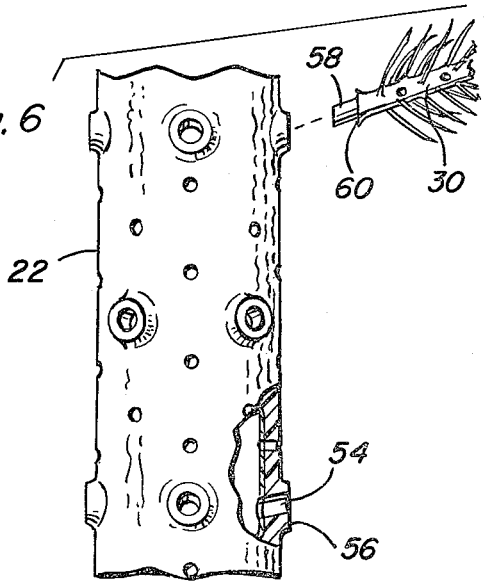
FIG. 6 is an enlarged fragmented view of the trunk of the Christmas tree display, partly in section, illustrating the means by which the tree branches are inserted into the trunk.

Trunk halves 22 and 24 are placed together at joint 40 as shown in FIGS. 1 and 3 and form a sectionalized trunk. As shown, upper half 22 is inserted within trunk half 24, shoulder 42 of trunk half 22 resting on the edge of trunk half 24, narrow portion 44 fitting within the interior of trunk half 24. Combined trunk halves 22 and 24 define an interior hollow space 46 as shown in FIGS. 2 and 3. Within hollow space 46 is placed an elongated light source 48, preferably a fluorescent light connected to an electrical source of current such as by electrical cord 34. The Mechanical Engineers' Handbook, 5th Edition, 1952, defines a fluorescent lamp or fluorescent light as primarily low-pressure vapor lamps which make use of the ultraviolet energy from the mercury-arc discharge to activate phosphors coated on the inside bulb surface. See page 1664. Light source 48 is secured within hollow space 46 at the bottom of trunk half 24 and extends longitudinally into the portions of hollow space 46 defined by upper trunk half 22. Each trunk half 22 and 24 contains an inner layer 50 comprising a light-reflective coating which will transmit and reflect the light emitted from light source 48 to light holes 52 contained on the exterior of the trunk halves. Light-reflective layer 50 can comprise a chrome coating composition or a synthetic resin, such as "Mylar", which will reflect light. Layer 50 can be pigmented and varied in color along the length of trunk halves 22 and 24 to produce a multi-colored effect on the exterior surfaces thereof. Light-reflective layer 50 is preferably sprayed onto the interior surfaces of the trunk halves, but other methods of coating which will produce a substantially uniform light-reflective coating can be utilized. Alternatively, layer 50 may be a solid surface laminated by heat sealing or with the addition of an adhesive to the internal surfaces of trunk halves 22 and 24. Placed around each trunk half 22 and 24 and extending longitudinally over the combined trunk are a series of apertures 54 which communicate with hollow space 46 and which include a shoulder portion 56 which secure and support branches 30 to the trunk halves, as shown best in FIGS. 3 and 6. Branches 30 include a narrow end portion 58 which can be inserted within aperture 54, each branch 30 including a wide shoulder portion 60 which abuts shoulder 56.

Figure 4:
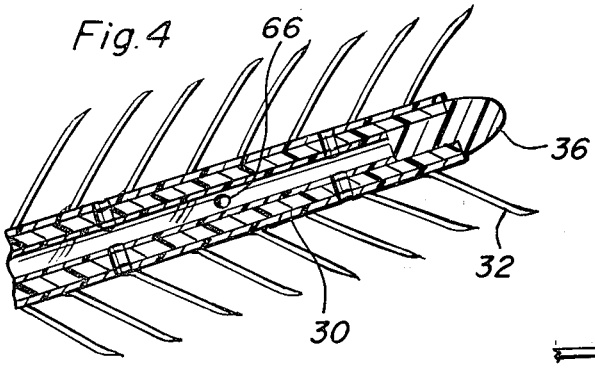
FIG. 4 is a cross-sectional view of a branch of the Christmas tree display illustrating the end of the branch.
Figure 5:
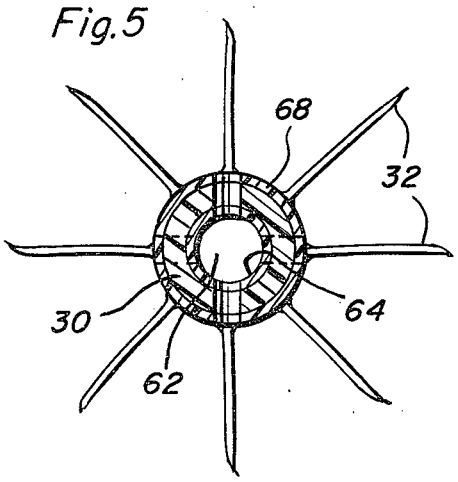
FIG. 5 is a transverse sectional view of a branch of the Christmas tree display taken generally along a line 5—5 of FIG. 3.

Referring to FIGS. 3, 4 and 5, it can be seen that each branch 30 defines a hollow space 62 which communicates with hollow space 46 defined by trunk halves 22 and 24. The interior surface of each branch 30 includes a layer of a light-reflective coating 64 which transmits and reflects the light of light source 48 to the exterior of branch 30, such as through light holes 66 and bulbs 36. Each branch can contain a plurality of light holes 66, bulbs 36, or a mixture of both types of light passing means. As in the case of light-reflective layer 50, light-reflective coating 64 can be composed of a plurality of different color shades producing a multi-colored effect on the exterior surface of branches 30. Coating 64 can be a solid laminate or a chrome based coating or a synthetic resin, such as "Mylar", and the like. Bulbs 36 are preferably formed of a transparent or translucent plastic which can transmit the light reflected from light-reflective coating 64 and can itself be colored to change the color of the reflected light. Bulbs 36 can also be formed into a variety of shapes which can be inserted into apertures 37 contained within branch 30 and communicating with hollow space 62. The bulbs are preferably placed on the ends of each branch, however, the branch can be formed so that a plurality of bulbs can be inserted onto any point along the length of branch 30.

Needles 32 added to tree display 20 simulate the needles of an evergreen tree and provide a more natural appearance. Needles 32 are preferably formed of plastic and attached to branches 30 by an adhesive layer 68 which is applied uniformly to the exterior surface of each branch 30. The needles can be applied by any conventional method, such as by hand, electrostatic spraying, or the like. Also, needles 32 can be formed in one operation during the forming of branch 30, especially if branch 30 is formed of a synthetic resin, such as by molding branch 30 and needles 32 in a single mold.

As can be readily ascertained, light emitted from light source 48 is transmitted and reflected by means of light-reflective layers 50 and 64 respectively to light holes 52 placed in trunk halves 22 and 24 and light holes 66 in selected branches 30. Further, light is also transmitted by means of reflective layer 64 to bulbs 36 placed on the exterior of branches 30 which emit the reflected light from the exterior of the display. The color of the light reflective layers 50 and 64 and bulb 36 determine the color which is emitted from the exterior of display 20. The color of light which is emitted from display 20 can be varied about the total exterior surface of the display by color variations in the light-reflective layers 50 and 64 and the color shades incorporated into bulbs 36.

An alternative form of Christmas tree display 20 is illustrated in FIG. 7 in which electrical cord 34 which connects a starter circuit (not shown) and the elongated light source 48 to a source of electrical power such as an electrical outlet is replaced by electrical storage battery 70 which is placed within hollow stand 26 togehter with any necessary conventional starter circuit. Since there is only one light source, an electrical storage battery is well suited for the optical displays of the present invention and the use of such a source of electrical power substantially eliminates the hazard of an electrical fire.

FIGS. 8 through 10 illustrate another type of display which can incorporate the principles of the present invention. In this alternative embodiment, an optical display is formed into the shape of a wreath 72 which will emit various color light effects along the exterior thereof. The body of wreath 72 is preferably formed in separate halves, a rearward or upper half 74 and a forward or lower half 76 which are formed into a single structure along joint 78 which includes groove 80 and tongue 82 of halves 74 and 76, respectively. Preferably, tongue 82 snaps into place within groove 80. A single source of light 84 provides for the emission of light from the exterior surface of wreath 72. As shown, light source 84 is a tubular light source which preferably follows the full circumference of wreath 72. Upper half 74 and lower half 76 are hollow and form hollow space 86 within which light source 84 is contained. Light source 84 is held in place by a plurality of clip members 88 and 90, each of which includes a pair of retaining arms 92 and 94 which are flexible but biased together to accept and hold light source 84 in place. Preferably, clip members 88 and 90 are formed of a resilient metal or plastic material. Clip members 88 and 90 are secured to upper half 74 of wreath 72 by means of rivets 96 and 98. Light source 84 is preferably a fluorescent light annular tube which is attached to a starter circuit and a source of electrical power by an electrical cord 100, although a storage battery can also be used as a source of electrical power. The internal surface of wreath 72 is lined with a light-reflective layer 102 similar to light-reflective layers 50 and 64 of tree display 20. Light holes 103 extend from the exterior surface of wreath 72 into hollow space 86 and emit the light emitted from light source 84 and reflected by light-reflective layer 102. As in the previous embodiments, light-reflective layer 102 can be of various colors to provide a multi-colored effect on the exterior surface of wreath 72. While not shown, wreath 72 can include apertures for holding transparent or translucent bulbs which also communicate with hollow space 86 and which will emit reflected light from the exterior surface.

The exterior surface of wreath 72 is provided with a plurality of needles 104 to produce a natural evergreen appearance. Needles 104 can be applied by an adhesive to the exterior surface of wreath 72 or can be molded in one piece with the upper and lower halves 74 and 76 of wreath 72. Preferably, upper and lower halves 74 and 76, respectively, are formed of a synthetic resin which is easily molded into the proper form. Wreath 72 can be placed upon a surface by means of attached hanging element 106 which can be attached to the body of wreath 72 by means of an adhesive or can be an integral part of wreath 72 produced by a molding technique.

Although the embodiment shown in the figures illustrate Christmas tree and wreath optical displays, any decorative display can incorporate the teachings of the present invention so long as the display can incorporate a light source and includes a light-reflective interior coating which will transmit and reflect light from the light source to the exterior of the decorative display. The use of a reflective layer or coating on the interior of the display and the use of a single light source greatly reduces and can even eliminate the fire hazard associated with electrically wired displays which include a plurality of light sources. Further, complex and expensive structure needed to hold a bundle of optical fibers together is not needed, although, bulbs 36 may be replaced with optical fibers if desired.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A decorative display which is able to emit light from the exterior thereof, comprising; a display body having an apertured exterior surface and a hollow interior defined by an internal surface, an elongated electric illumination means contained and positioned within said interior, at least a portion of the internal surface of said display body being covered with a light-reflective layer which is in communication with said illumination means and the light reflective layer being capable of transmitting and reflecting light from said illumination means, and light transmitting means extending from said exterior surface to said interior to receive light from said illumination means and reflected light from said layer and transmit said light from apertures in said exterior surface.

2. The display of claim 1 wherein said illumination means is an electric fluorescent light.

3. The display of claim 1 wherein said light-reflective layer is of a different color than the light emitted from said illumination means.

4. The display of claim 1 wherein said light transmitting means further includes a transparent or translucent hollow bulb placed in communication with a through hole extending from said exterior surface to said hollow interior.

5. The display of claim 1 wherein a plurality of said light transmitting means are included in said display body.

6. The display of claim 1 wherein the exterior surface defines a simulated tree including a sectionalized trunk and a plurality of branches, said trunk containing said hollow space and incorporating said illumination means.

7. The display of claim 6 wherein said branches are also hollow and include an internal surface and an exterior surface, the internal surface of said branches including a coating of light-reflecting material, the internal surface of said branches communicating with the hollow space of said trunk, said branches including light transmitting means extending from the internal surface of said branch to the exterior surface thereof.

8. The display of claim 7 wherein transparent or translucent bulbs are placed within said branches.

9. The display of claim 5 wherein said display is in the form of a wreath in which the internal surface thereof defines said hollow interior containing said fluorescent illumination means and being in the shape of said hollow interior.

10. The display of claim 9 wherein said wreath is formed into an upper half and a lower half which are joined together to define said hollow space.

11. The display of claim 1 wherein said illumination means is connected to a source of electrical current.

12. The display of claim 11 wherein said source of electrical current is a battery.

* * * * *